US009874220B2

(12) United States Patent
Adams

(10) Patent No.: US 9,874,220 B2
(45) Date of Patent: Jan. 23, 2018

(54) ANTI-SWIRL DEVICE

(71) Applicant: Flowserve Management Company, Irving, TX (US)

(72) Inventor: Douglas Adams

(73) Assignee: Flowserve Management Company, Irving, TX (US)

( * ) Notice: Subject to any disclaimer, the term of this patent is extended or adjusted under 35 U.S.C. 154(b) by 275 days.

(21) Appl. No.: 14/411,654

(22) PCT Filed: Jun. 26, 2013

(86) PCT No.: PCT/US2013/047824

§ 371 (c)(1),
(2) Date: Dec. 29, 2014

(87) PCT Pub. No.: WO2014/004628

PCT Pub. Date: Jan. 3, 2014

(65) Prior Publication Data

US 2015/0211543 A1 Jul. 30, 2015

Related U.S. Application Data

(60) Provisional application No. 61/664,949, filed on Jun. 27, 2012.

(51) Int. Cl.
*F04D 17/10* (2006.01)
*F04D 29/30* (2006.01)
(Continued)

(52) U.S. Cl.
CPC ..... *F04D 29/30* (2013.01); *F04D 17/10* (2013.01); *F04D 29/08* (2013.01); *F04D 29/162* (2013.01);
(Continued)

(58) Field of Classification Search
CPC ..... F04D 17/10; F04D 29/66; F04D 29/667; F04D 29/4206
See application file for complete search history.

(56) References Cited

U.S. PATENT DOCUMENTS 2,361,521 A 10/1944 Yates
3,265,001 A 8/1966 Deters
(Continued)

FOREIGN PATENT DOCUMENTS

EP 1905963 A2 4/2008
SU 1204808 A1 1/1986
(Continued)

OTHER PUBLICATIONS

NASA/TM—20004-211991/Part 2, pp. 20-21, Jul. 2004.*
(Continued)

*Primary Examiner* — Woody Lee, Jr.
(74) *Attorney, Agent, or Firm* — Dinsmore & Shohl LLP

(57) ABSTRACT

A device to limit pre-rotation of fluid across turbomachinery regions where significant pressure differentials exist between rotating and non-rotating components. In one form, the present invention is particularly applicable to centrifugal-based turbomachinery. Of particular concern is that the highly-energized fluid exiting an impeller or related rotating member can impart significant swirl velocity and related rotordynamic forces which in turn may impact rotor stability. The potential for such instability is particularly high when flow coming from an impeller discharge permeates a seal, bushing or related component that is used to fluidly separate the impeller from an upstage partition. The present invention replaces traditional bushing seal designs at swirl-prone regions with a vaned anti-swirl bushing that fits within the housing without increasing the axial or radial dimensions of the housing.

20 Claims, 4 Drawing Sheets

(51) Int. Cl.

| | |
|---|---|
| ***F04D 29/66*** | (2006.01) |
| ***F04D 29/08*** | (2006.01) |
| ***F04D 29/16*** | (2006.01) |
| ***F04D 29/42*** | (2006.01) |
| *F04D 17/12* | (2006.01) |
| *F04D 29/047* | (2006.01) |
| *F04D 29/057* | (2006.01) |

(52) U.S. Cl.
CPC ..... *F04D 29/167* (2013.01); *F04D 29/4206* (2013.01); *F04D 29/426* (2013.01); *F04D 29/667* (2013.01); *F04D 29/669* (2013.01); *F04D 17/122* (2013.01); *F04D 29/0473* (2013.01); *F04D 29/057* (2013.01)

(56) References Cited

U.S. PATENT DOCUMENTS 4,063,846 A * 12/1977 Eagle ..... F04D 29/2266 384/425
4,355,953 A 10/1982 Nelson
5,282,718 A * 2/1994 Koff ..... F01D 11/08 415/57.3
5,320,482 A 6/1994 Palmer et al.
5,431,533 A * 7/1995 Hobbs ..... F01D 5/145 415/145
7,670,110 B2 3/2010 Erler et al.
7,775,763 B1 * 8/2010 Johnson ..... F04D 29/167 415/111
8,052,375 B2 * 11/2011 Turnquist ..... F01D 11/04 415/57.4
8,727,713 B2 * 5/2014 Ono ..... F01D 11/005 415/173.6
9,200,528 B2 * 12/2015 Zheng ..... F01D 11/02
2012/0183388 A1 * 7/2012 Vannini ..... F04D 29/122 415/111
2014/0205444 A1 * 7/2014 Zheng ..... F01D 11/04 415/173.1

FOREIGN PATENT DOCUMENTS

SU 1581864 7/1990
WO 2012001995 A1 1/2012

OTHER PUBLICATIONS

Storteig, E., Dynamic Characteristics and Leakage Performance of Liquid Annular Seals in Centrifugal Pumps, [doctorial thesis] Nov. 30, 1999; pp. 1-198, Norwegian University of Science and Technology.
Extended European Search Report dated Feb. 18, 2016 pertaining to European Patent Application No. 13810139.9.

* cited by examiner

ANTI-SWIRL DEVICE

This application claims priority to U.S. Provisional Application 61/664,949, filed Jun. 27, 2012.

BACKGROUND OF THE INVENTION

This invention relates generally to a way to improve the rotordynamic performance of turbomachinery, and more particularly to reducing the pre-rotation of a working fluid entering leakage areas of centrifugal turbomachinery such that the dampening and stiffening characteristics of the leakage areas are altered.

Seals and related structure (sometimes referred to as radial running clearances) are used as pressure breakdown devices in order to limit leakage from high to low pressure regions in fluid handling turbomachinery, thus raising the volumetric efficiency of such machines. In the present context, such turbomachinery may be in the form of a centrifugal compressor (also called a centrifugal-flow compressor, as distinguished from an axial-flow device) or related dynamic or kinetic platform configured to pump various types of liquid or gaseous fluids. One specific example of such a machine produced by the Assignee of the present invention is an API/ANSI-compliant process pump that is useful in gas-to-liquid (GTL) facilities or other chemical processing environments. Such a pump may be used to deliver GTL fuels and products, as well as condensates, liquified petroleum, ethane and related oil equivalents. Seals in such machines are typically placed at the interface between static and dynamic components (for example, between a rotating shaft and the stationary housing that provides support to the shaft) where the likelihood of leakage is highest.

The rotordynamic behavior of turbomachinery is influenced by forces that are produced in its radial running clearances. Pre-rotation—which can be imparted to the fluid by the rotating components of the machine—of the pressurized fluid entering the radial running clearances may alter these forces. The swirl velocity of the leakage flow as it enters these clearances is a significant determinant of whether the rotordynamic forces tend to stabilize or destabilize a given rotor, where lower swirl velocity tends to be more favorable to rotor stability. A pressurized fluid impinging on a seal is generally possessive of some swirl velocity; this quantity is typically quantified as a swirl coefficient, which is the ratio of the swirling fluid's velocity to that of the adjacent rotating surface. Traditionally, the swirl coefficient was assumed to be 0.5; however, more recent studies using computational fluid dynamics (CFD) analyses have shown that the actual swirl coefficient (and concomitant greater likelihood of rotor-dynamic instabilities) can be significantly higher than 0.5, often on the order of 0.8 to 0.9. This is particularly the case when leakage flow comes from an impeller discharge and travels radially inward to the seals through a relatively narrow volumetric region separating the impeller from its immediately upstream housing, casing or related stationary partition.

Traditional approaches to mitigating swirl-induced instability have tended to focus on using axial anti-swirl slots, cutouts or apertures formed in the stationary component that (along with its adjacent impeller) makes up the radial running clearance. However, such approaches are only effective if there is sufficient axial length in the running clearance for the slots to arrest the pre-rotation and for the running clearance to be effective in controlling the leakage rate. This in turn tends to an undesirable increase in the size of the machinery, which is especially problematic in centrifugal-flow devices where compactness of design is a more significant design consideration than in its axial-flow counterparts. Instead, such machines keep their dimensions as compact as possible, resulting in insufficient depth for the axial anti-swirl slots to be effective in removing pre-rotation. This is compounded by the fact that CFD analysis has shown that it is desirable to place the anti-swirl slots as close to the inlet of the seals or related leakage sources as possible in order to be effective.

BRIEF SUMMARY OF THE INVENTION

According to a first aspect of the present invention, a pump includes a centrifugal compressor impeller with anti-swirl features in the form of a stationary vaned ring placed in a region between the impeller and an adjacent part of the pump housing that defines a flowpath where leakage may form. In a particular form, an eye side bushing (i.e., the seal located at the interface between the inlet of the rotating impeller and the adjacent housing) may become less prone to leakage through the placement of the vaned ring that is formed in a recess defined within the radially-adjacent partition or related housing component. In this way, the vanes (which are spaced along the ring's periphery) help to remove or reduce the tangential velocity of a forward-flowing portion of the swirling fluid that has been pressurized by the impeller discharge and that has leaked to a radial running clearance formed between the impeller and the upstream wall or related housing partition. As mentioned above, this helps promote enhancement in rotor stability. In one form, the vanes may be shaped to resemble small airfoils (such as the vanes and vanes used in the turbine section of a gas turbine engine). In a more particular form, the vanes may be part of a vaned ring that may be placed within a cutout or related recess formed in the upstream wall housing such that none of the vanes project into the axial gap. Moreover, placement of the vaned ring is such that it is adjacent a bushing or related sealing mechanism that is formed between the housing and impeller; in this way, the reduction of the swirl motion of the leakage portion that passes through the vanes may be delivered adjacent such bushing without having to flow through a substantial entirety of the axial gap of the radial running clearance. In more particular forms, the centrifugal compressor may be either a single-stage or multi-stage device. The placement and shape of the vanes is such that a portion of the fluid being pressurized by the rotational movement of the impeller that migrates forward flows radially inward; the tangential (i.e., swirl) component of this flow tends to become more straightened out into a more manageable purely radial component. Placement of the vaned ring is preferably adjacent an eye side bushing that forms the seal or related interface between the rotating impeller and the adjacent housing. As discussed above, the vanes may be shaped to resemble small airfoils such that as they help in such flow redirection to promote both operational stability of the compressor and reduced leakage through the bushing.

According to another aspect of the present invention, a method of improving rotordynamic stability in a centrifugal pump is disclosed. The method includes configuring a pump to have a housing with at least one centrifugal-flow impeller; an axial gap in the form of a radial running clearance is defined between them. The fluid is pressurized by the impeller such that at least a portion of the pressurized fluid is received within the radial running clearance; this portion contains at least some swirl motion energy content. This fluid is routed through numerous anti-swirl vanes that are formed within the radial running clearance in such a way that the vanes cause a reduction in swirl motion while also defining a profile that avoids taking up space within the axial gap.

According to still another aspect of the present invention, a method of reducing the amount of swirl in a centrifugal compressor is disclosed. A stationary vaned ring is formed in a region between a centrifugal compressor impeller and a pump housing such that as a portion of the fluid being pressurized by the rotational movement of the impeller migrates forward (rather than rearward to a discharge or subsequent compressor stage, as designed), the tangential component of its flow tends to become more straightened out into a more manageable purely radial component. Placement of the vaned ring is adjacent an eye side bushing that forms a sealing interface between the rotating impeller and the adjacent housing. More particularly, the placement of the vaned ring is preferably in a recess formed in the portion of the housing; such recess may be radially adjacent to the bushing such that the two occupy the same general area within the housing to avoid occupying space within an axial gap formed between the impeller and an upstream wall of the housing. The airfoil shape of the vanes in the ring are such that the removal or reduction of the tangential flow promotes operational stability of the compressor by reducing periodic (or time-varying) pressure loads. In addition to improving operational stability, such flow pattern helps reduce leakage through the bushing.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
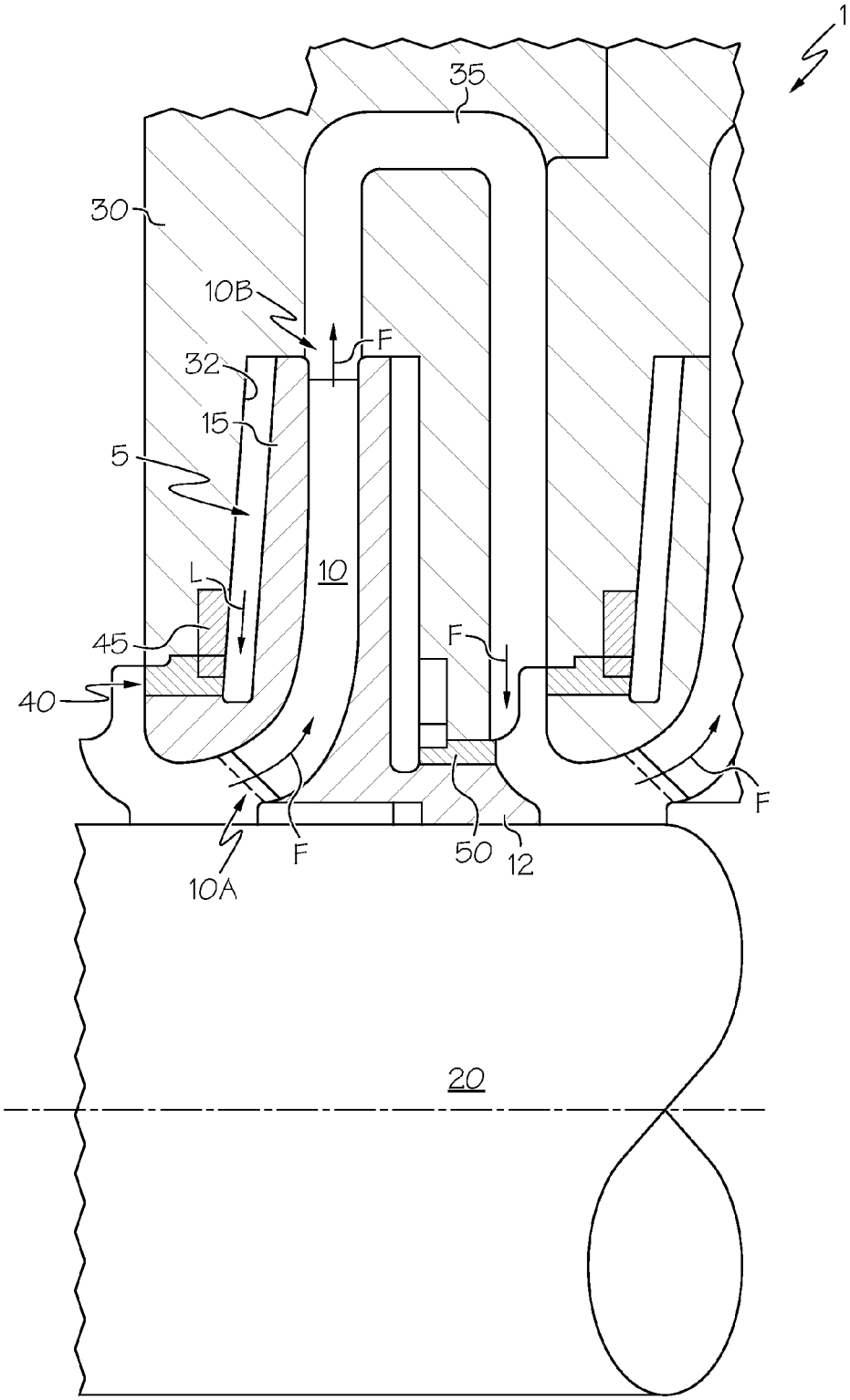
FIG. 1 (PRIOR ART)
FIG. 1 shows one stage of a centrifugal compressor with a conventional leakage control bushing placed near the impeller inlet.

Referring first to FIG. 1, a centrifugal pump 1 includes a centrifugal impeller 10 mounted onto a shaft 20 that rotates about an axis 25. Impeller 10 and shaft 20 are disposed within a stationary housing (or casing) 30 that can be made from numerous parts that can be assembled or otherwise secured together into a unitary whole. A radial running clearance 5 defines a generally empty volume between the impeller 10 and an adjacent wall 32, partition or related part of housing 30. Impeller 10, which may integrally-formed as part of a larger rotating stage 12, includes a suction or inlet 10A and a discharge or outlet 10B to define a flowpath through which a working fluid (such as water, oil, air or the like) passes. Shrouds 15 are included axially forward and aft of the impeller 10 to form a rigid pressurizing part of stage 12. Arrows indicate the flow F of the working fluid through impeller 10 as an increased energy content (typically in the form of higher pressure, velocity or both) is imparted to it due to the rotational movement of impeller 10. The flowpath defined by arrows F extend initially in an axial direction along shaft 20 at suction 10A and then in a radially outward direction away from the shaft 20 toward the impeller discharge 10B. Other arrows indicate one possible leakage flow L in and around impeller 10. One prominent leakage flow L occurs upstream of the impeller 10 by virtue of gaps between the rotating tip of impeller 10 and an adjacent flow channel 35 that is formed in housing 30. Because the pressure at the radially outward tip or periphery of the rotating impeller 10 is significantly higher than its hub or root that is closest to the shaft 20, the leakage flow L typically originates at the periphery and flows in the radially-inward direction indicated.

Suction-side bushings 40 and discharge-side bushings 50 act as bearing-like surfaces at the regions where the rotational movement of the impeller 30 and the housing 30 intersect. These bushings 40, 50 may—in addition to performing bearing-like functions—perform as mechanical seals to help provide fluid isolation. In another form, separate seals (not shown) may also be used. Slotted region 45 formed adjacent the suction-side bushing 40 is used as a conventional leakage limiting anti-swirl mechanism according to the prior art for centrifugal pump 1. The close proximity of shrouds 15 to the adjacent stationary wall of housing 30 imparts shearing effect that in turn produces a swirling component to the leakage flow L. This leakage flow L can, if not properly attenuated, cause rotordynamic instability through its interaction with bushing 40.

In general, the leakage flow in the back hub of the impeller 10 is less, as the fluid in the region adjacent to the suction of the succeeding stage impeller (only partially shown) is possessive of a higher static pressure (due to the diffusion of the high velocity liquid leaving impeller 10). Likewise, the swirl velocity entering the discharge-side bushing 50 tends to be lower. As such, these latter-stage leakage flows do not contribute as much to the risk of rotor-dynamic instability. As mentioned above, the placement and relative lack of axial depth of the slotted region 45 tends to limit its ability to minimize swirl, which in turn hampers its ability to promote rotordynamic stability.

Figure 2:
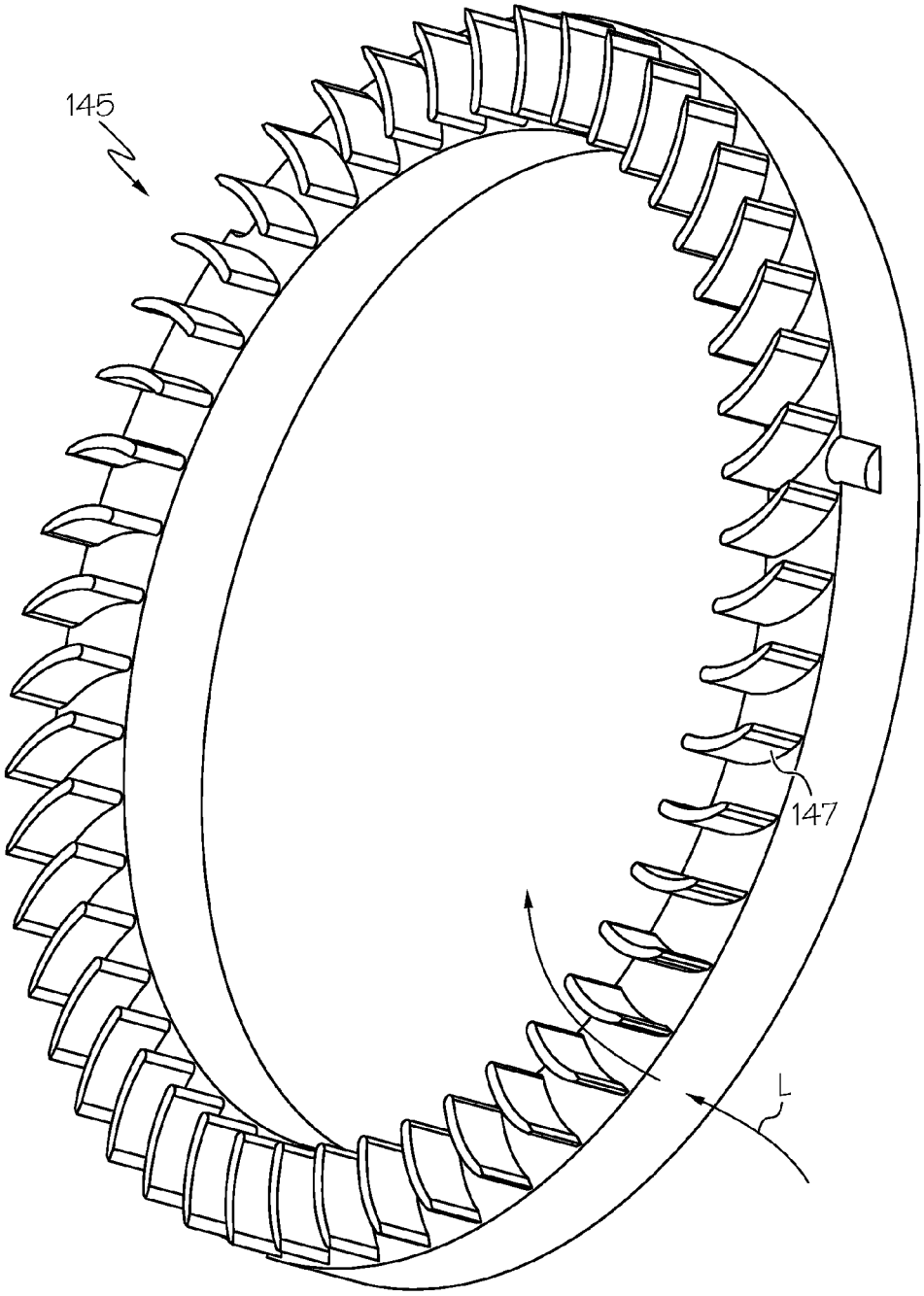
FIG. 2 shows a three dimensional view of a vaned ring used in conjunction with an anti-swirl bushing according to an aspect of the present invention.
Figure 3:
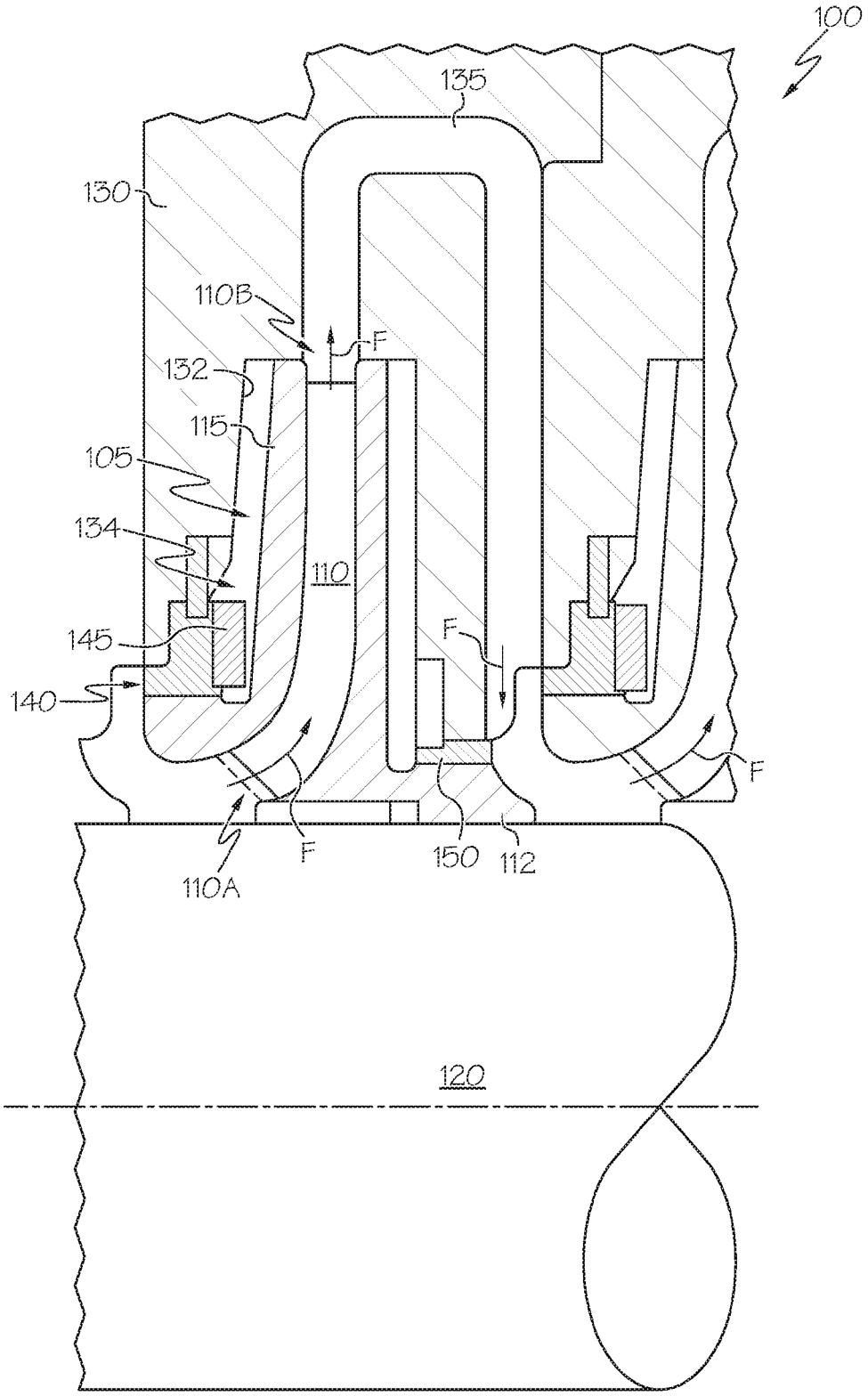
FIG. 3 shows the vaned ring of FIG. 2 that is used to promote anti-swirl fluid behavior bushing placed into the housing of a centrifugal compressor.

Referring next to FIGS. 2 and 3, placement of a vaned ring 145 into a multi-staged centrifugal compressor (or pump) 100 helps to improve rotordynamic stability. In one preferred form, a rotating impeller 110 includes shrouds 115, while an axial gap in the form of a radial running clearance 105 defines a volume between the impeller 110 and an adjacent wall 132 of housing 130 where the cooperation between the rotary movement of the impeller 110 (with or without the shrouds 115) and stationary housing wall 132 cause the shearing effects and swirling movement on the fluid that is present in radial running clearance 105. One of the features of the present invention is that it includes an array (cascade) of inward, radial flow vanes or vanes 147. Their placement is in the region immediately above the bushing 140, and may be either integrally-formed with or separate from the same. For example, as shown, a recess 134 may be cut into the impeller-facing stationary surface of wall 132 of housing 130 to further increase the area of interaction between the vanes 147 and the leakage flow L. Another of the features is that the vane 147 geometry and number are chosen to (a) have nominally zero incidence with the leakage flow at the array (cascade) inlet and (b) have a curvature and rate of curvature change to produce a swirl coefficient of nominally zero in the flow leaving the array (cascade) that is being conveyed to the region adjacent bushing 140. Still another feature includes stage partition geometry to encourage flow through the cascade-like vane array of the vaned ring 145 rather than around it.

Vaned ring 145 may be formed as part of an inlet-side bushing 140. The vanes 147 are such that when they receive swirled fluid from the radial running clearance 105 upstream of the impeller 110, they interact with a significant portion of the impeller-generated leakage flow that enters into the clearance 105. The vanes 147 are configured to turn the swirling fluid in a direction that will remove a significant portion of the swirl before the leakage enters the bushing 140 or seal that acts as an interface between the rotational movement of the impeller 110 and the stationary position of the housing 130. In a preferred form, the cascade formed by the plurality of vanes 147 defines a substantially radial inward flowpath between the radial running clearance 105 and the bushing 140.

In one preferred form, the vaned ring 145 is sized such that it fits within the complementary-shaped cutout or recess 134 that is formed within the dividing wall 132 or related partition that defines the forward-end of the radial running clearance 105 on a suction side of impeller 110. As stated above, preferably, the vaned ring 145 is placed upstream of the impeller 110 where it can be the most effective. Importantly, the size and placement of vaned ring 145 within recess 134 is such that there is substantially no rearward axial projection of the tips of the vanes 147 beyond the wall 132, in essence forming a fit that avoids any projection into the axial gap formed between them. As mentioned above, such preservation of axial compactness is particularly important in centrifugal-flow turbomachinery such as pump 100. Moreover, the radially inward direction toward the inlet of the leakage gap that is formed near the root/base of the impeller 110 and bushing 140 (also called the eye-side bushing that may also include sealing functions) promotes a more efficient use of the vanes' anti-swirling features than if they were located in a more radially-outward part of the housing 130.

Figure 4:
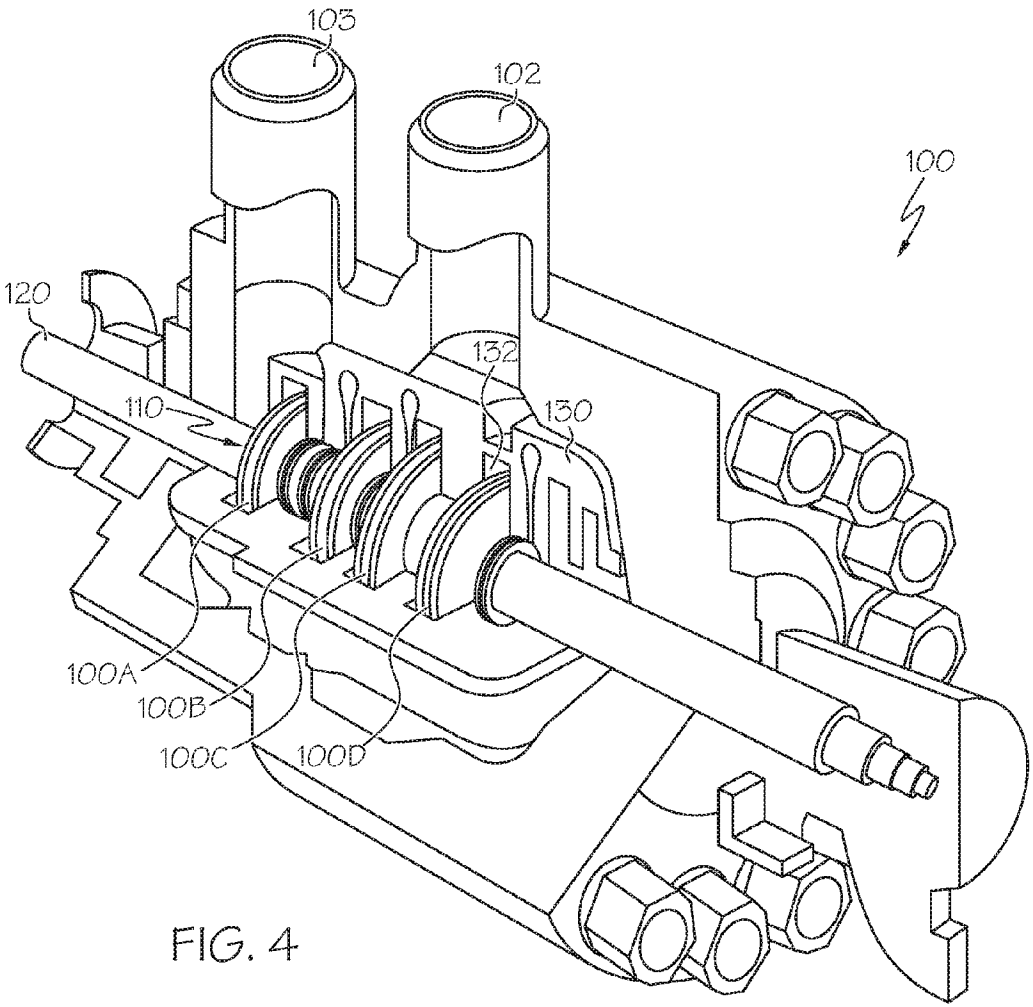
FIG. 4 shows a partial cutaway view of a chemical process pump that may use the vaned anti-swirl bushing of the present invention.

Referring next to FIG. 4, a partial cutaway version of pump 100 is shown. As shown, pump 100 includes multiple stages, four of which are shown as 100A, 100B, 100C and 100D, each of which is defined by impeller 110 placed adjacent walls 132 of housing 130. Such pumps, which are capable of developing significant pressure heads (up to 22,000 feet), pressures (up to 6,000 pounds per square inch), flows (up to 10,000 gallons per minute) and temperatures (up to 850 degrees Fahrenheit) are useful in numerous refining, petrochemical and related applications. More particular uses may include those for hydraulic decoking fluid operations, gas-to-liquid (GTL) conversion, or the like. The present invention is preferably used in conjunction with a radially split configuration rather than an axially split configuration where the latter is commonly used in multi-stage pumps by having the pump case or housing be split in half along a horizontal center line to permit the top half of the housing to be removed to receive the bladed rotor, impeller or related element. Because the halves of a horizontally split configuration are typically joined by bolted flanges rather than around the housing circumference, such splitting approaches have a tendency to grow eccentrically or out of round, which in turn allows the high pressures inherent in multi-stage devices to leak at the location where the top and bottom housing halves join. As such, it is better-suited to adjusting the angular orientation of the vanes should a different degree of anti-swirl is desired. Such a casing split makes it much easier to adjust the vane orientation relative to the hydraulic passage feeding the impeller 110.

Having described the invention in detail and by reference to preferred embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

The invention claimed is:

1. A pump comprising:

a housing defining a flowpath where pumped fluid leakage may form, the flowpath defining at least one cutout formed in said housing;

at least one centrifugal-flow impeller disposed in said housing, said impeller configured to impart swirl motion to a fluid introduced thereto; and at least one stationary component defining a plurality of anti-swirl vanes comprising an airfoil shape thereon, said stationary component placed in said cutout within said housing that is axially upstream of and fluidly cooperative with an inlet of said impeller to define an axial gap between said impeller and said housing that receives a leakage portion of said fluid that contains said swirl motion such that upon interaction of said plurality of vanes and said leakage portion, said plurality of vanes cause a reduction in said swirl motion of said leakage portion.

2. The pump of claim 1, wherein said at least one stationary component comprises at least one vaned ring disposed within a recess defined in said housing such that none of said plurality of vanes project into said axial gap.

3. The pump of claim 2, wherein said at least one vaned ring is placed adjacent a bushing that is formed between said housing and said impeller such that upon passage of said leakage portion through said vaned ring, said reduction in swirl motion of said leakage portion is delivered adjacent said bushing without having to flow through a substantial entirety of said axial gap.

4. The pump of claim 3, wherein said at least one vaned ring is formed as a part of said bushing.

5. The pump of claim 3, wherein said bushing forms a seal between said housing and said impeller.

6. The pump of claim 1, wherein said plurality of vanes comprise a fixed angular orientation within said housing.

7. The pump of claim 1, wherein said plurality of vanes define a substantially radial inward flowpath therethrough.

8. The pump of claim 7, wherein said plurality of vanes are configured such that an angle of incidence into said plurality of vanes is in a substantially radial direction and an angle of discharge is angled to impart a swirl motion to said leakage portion that is in an opposite swirling direction of said swirl motion of said leakage portion that has not passed through said plurality of vanes.

9. The pump of claim 1, wherein said housing defines a radially split configuration.

10. A method of improving rotordynamic stability in a centrifugal pump, said method comprising:

configuring a pump to comprise a housing with at least one centrifugal-flow impeller disposed therein such that a radial running clearance is defined therebetween, said housing defining at least one cutout formed within an upstream portion of said radial running clearance;

pressurizing said fluid with said impeller such that at least a portion of said pressurized fluid is received within said radial running clearance axially upstream and fluidly cooperative with an inlet of said impeller, said portion possessive of a swirl motion imparted thereto; and routing at least some of said portion through at least one stationary component formed within said at least one cutout in said radial running clearance, said at least one stationary component defining plurality of anti-swirl vanes comprising an airfoil shape such that upon interaction of said plurality of vanes and said some of said portion, said plurality of vanes cause a reduction in said swirl motion of said some of said portion.

11. The method of claim 10, wherein said at least one stationary component comprises at least one vaned ring disposed within a recess defined in said housing such that none of said plurality of vanes project into said radial running clearance.

12. The method of claim 11, wherein said some of said portion with said reduced swirl motion is delivered to a sealing mechanism that is formed between said housing and said impeller such that upon passage of said some of said portion through said vaned ring, said reduction in swirl motion of said some of said portion takes place adjacent said sealing mechanism without having to first flow through a substantial entirety of said radial running clearance.

13. The method of claim 12, wherein said sealing mechanism comprises a bushing that defines an interface between a rotating surface of said impeller and a stationary surface of said housing.

14. The method of claim 13, wherein said reduction in said swirl motion of said some of said portion comprises a swirl coefficient of below 0.5.

15. The method of claim 14, wherein said housing defines a radially split configuration.

16. A method of reducing leakage flow swirl in a centrifugal pump, said method comprising:

pressurizing a fluid with an impeller from said pump such that at least a portion of said pressurized fluid possessive of a swirl component is leaked into a radial running clearance defined in front of and upstream of and fluidly cooperative within an inlet of said impeller between said impeller and a housing defining a flowpath where pumped fluid leakage may form, the flowpath defining at least one cutout formed in said housing; and routing at least some of said portion through a plurality of anti-swirl vanes comprising an airfoil shape that are formed within said at least one cutout such that said plurality of anti-swirl vanes cause a reduction in said swirl motion of said at least some of said portion.

17. The method of claim 16, wherein said plurality of anti-swirl vanes are placed within a recess as part of a vaned ring in said housing such none of said plurality of anti-swirl vanes project into said radial running clearance.

18. The method of claim 17, wherein said at least some of said portion is delivered to a sealing mechanism that is formed between said housing and said impeller such that upon passage of said some of said at least some of said portion through said vaned ring, said reduction in swirl motion takes place adjacent said sealing mechanism without having to first flow through a substantial entirety of said radial running clearance.

19. The method of claim 18, wherein said sealing mechanism comprises a bushing that defines an interface between a rotating surface of said impeller and a stationary surface of said housing.

20. The method of claim 19, wherein said reduction in said swirl motion comprises a swirl coefficient of below 0.5.

* * * * *